US009707756B2

(12) United States Patent
Kusunoki et al.

(10) Patent No.: US 9,707,756 B2
(45) Date of Patent: Jul. 18, 2017

(54) INKJET HEAD AND INKJET RECORDING APPARATUS

(71) Applicant: TOSHIBA TEC KABUSHIKI KAISHA, Tokyo (JP)

(72) Inventors: Ryutaro Kusunoki, Mishima Shizuoka (JP); Shuhei Yokoyama, Mishima Shizuoka (JP); Ryuichi Arai, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/048,718

(22) Filed: Feb. 19, 2016

(65) Prior Publication Data

US 2016/0279942 A1 Sep. 29, 2016

(30) Foreign Application Priority Data

Mar. 23, 2015 (JP) ..... 2015-059672

(51) Int. Cl.
*B41J 2/18* (2006.01)
*B41J 2/14* (2006.01)

(52) U.S. Cl.
CPC ..... *B41J 2/14298* (2013.01); *B41J 2/1433* (2013.01); *B41J 2/14201* (2013.01); *B41J 2/14233* (2013.01); *B41J 2/18* (2013.01); *B41J 2002/1437* (2013.01); *B41J 2202/12* (2013.01); *B41J 2202/15* (2013.01)

(58) Field of Classification Search
CPC ..... B41J 2/18; B41J 2/14298; B41J 2/1433; B41J 2/14233; B41J 2/14201
See application file for complete search history.

(56) References Cited

U.S. PATENT DOCUMENTS

2013/0070030 A1 3/2013 Kusunoki et al.
2013/0271530 A1* 10/2013 Yokoyama ..... B41J 2/045 347/70

FOREIGN PATENT DOCUMENTS

JP 2014172323 9/2014
JP 2014176977 9/2014

* cited by examiner

*Primary Examiner* — Geoffrey Mruk
(74) *Attorney, Agent, or Firm* — Patterson & Sheridan, LLP

(57) ABSTRACT

According to an embodiment, an inkjet head includes a pressure cell structure. The pressure cell structure includes pressure cells, flow control paths, and slits. The flow control paths are formed on both the sides of the pressure cells, and control flow of ink flowing into the pressure cells. The slits are in communication with the pressure cells and the flow control paths. The width of the slit is smaller than the width of the pressure cell.

15 Claims, 7 Drawing Sheets

INKJET HEAD AND INKJET RECORDING APPARATUS

CROSS-REFERENCE TO RELATED APPLICATIONS

This application is based upon and claims the benefit of priority from the prior Japanese Patent Application No. 2015-059672, filed on Mar. 23, 2015, the entire contents of which are incorporated herein by reference.

FIELD

Embodiments described here generally relate to an inkjet head and an inkjet recording apparatus.

BACKGROUND

For example, an on-demand inkjet head ejects ink drops toward recording paper, and an image is thereby formed on the recording paper. Such kind of inkjet head includes nozzles and actuators corresponding to each other one to one.

Piezoelectric actuators are formed on the surface of a substrate, and nozzle holes are formed corresponding to the actuators. Further, pressure cells are formed in the substrate corresponding to the actuators, the pressure cell starting from the back surface of the substrate and ending at the actuator. Further, ink is introduced from the back surface of the substrate and filled in the pressure cells, the actuators pressurize the ink filled in the pressure cells, and the inkjet head ejects the ink from the nozzle holes.

In the inkjet head, when printing, air bubbles may enter the pressure cells from the nozzles and the ink supply paths. In this case, the actuators cannot pressurize the ink, and the ink is ejected poorly. In order to recover from such poor ink ejection, it is necessary to stop printing, and to suck out the ink from the nozzles.

DETAILED DESCRIPTION

Figure 1:
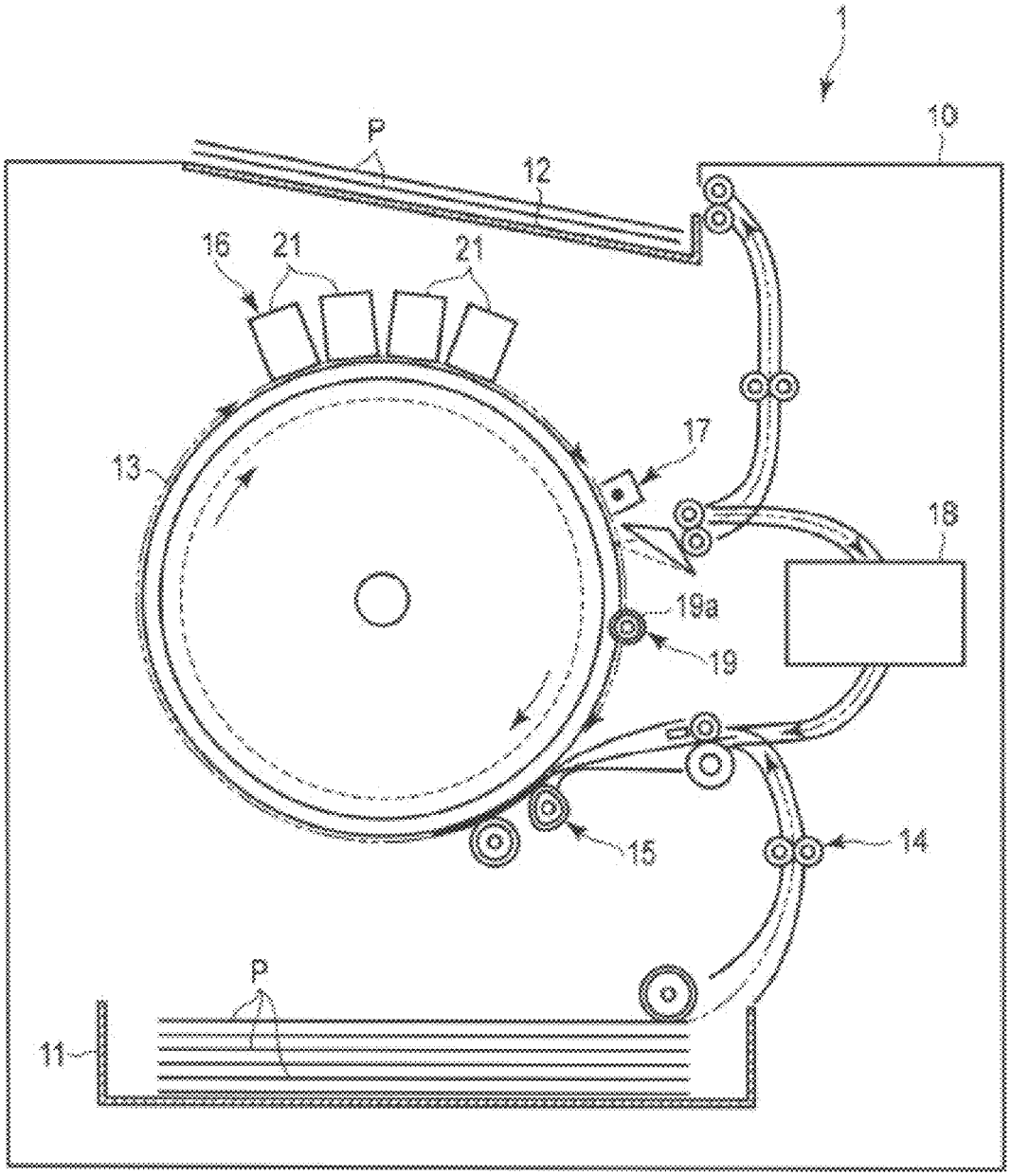
FIG. 1 is a longitudinal sectional view schematically showing an inkjet recording apparatus of a first embodiment.

According to one embodiment, an inkjet head includes a pressure cell structure, a nozzle plate, and an ink flow path structure. The pressure cell structure includes pressure cells that retain ink, each of the pressure cells being formed in a thickness direction of the pressure cell structure from one end surface to the other end surface. The pressure cell structure further includes flow control paths that control flow of the ink flowing into the pressure cells, the flow control paths being formed at both the sides of the pressure cells, the pressure cells being interposed between the flow control paths, each of the flow control paths being formed in the thickness direction of the pressure cell structure from the one end surface of the pressure cell structure to the other end surface. The pressure cell structure further includes slits, each of the slits being in communication with each of the pressure cells and each of the flow control paths, each of the slits having a width smaller than a width of each of the pressure cells. The nozzle plate includes actuators formed on the one end surface of the pressure cell structure, each of the actuators covering each of the pressure cells, the actuators deforming in the thickness direction of the pressure cell structure depending on a drive voltage. The nozzle plate further includes nozzles, each of the nozzles being formed corresponding to each of the actuators, each of the nozzles being in communication with each of the pressure cells, each of the nozzles ejecting the ink retained in each of the pressure cells. The ink flow path structure is bonded to the other end surface of the pressure cell structure. The ink flow path structure includes ink flow paths in communication with each of the pressure cells via each of the flow control paths and each of the slits.

Hereinafter, embodiments will be described with reference to the drawings. In the drawings, the same reference symbols show the same or similar parts.

First Embodiment

FIG. 1 to FIG. 6 show a first embodiment. Note that each element, which can be expressed by some terms, may sometimes be expressed by another term or other terms. However, it does not mean that any element, which is only expressed by a single term, is never expressed by another term or other terms. In addition, it does not mean that another term or other terms, which is/are not exemplified, is/are never used to express each element.

FIG. 1 is a cross sectional view showing the inkjet printer 1 of the first embodiment. The inkjet printer 1 is an example of an inkjet recording apparatus. Note that an inkjet recording apparatus may be another apparatus such as a copy machine instead of the inkjet printer.

As shown in FIG. 1, the inkjet printer 1 conveys recording paper P, for example, as a recording medium, and at the same time, performs various processes such as image forming. The inkjet printer 1 includes the housing 10, the paper cassette 11, the copy receiving tray 12, the holding roller (drum) 13, the conveyer apparatus 14, the holding apparatus 15, the image forming apparatus 16, the static-eliminating and peeling apparatus 17, the inversing apparatus 18, and the cleaning apparatus 19.

The paper cassette 11 stores a plurality of sheets of recording paper P, and arranged in the housing 10. The copy receiving tray 12 is arranged at the top of the housing 10. The inkjet printer 1 forms an image on recording paper P, and discharges the recording paper P to the copy receiving tray 12.

The conveyer apparatus 14 includes guides and conveyer rollers arranged along the path on which the recording paper P is conveyed. The conveyer roller is driven by a motor, rotates, and thus conveys the recording paper P from the paper cassette 11 to the copy receiving tray 12.

The holding roller 13 includes a cylindrical frame made of a conductor, and a thin insulation layer formed on the surface of the frame. The frame is grounded. The holding roller 13 rotates where it holds the recording paper P on its surface, and thus conveys the recording paper P.

The holding apparatus 15 presses the recording paper P, which is discharged from the paper cassette 11 by the conveyer apparatus 14, on the surface (outer surface) of the holding roller 13. The holding apparatus 15 presses the recording paper P on the holding roller 13, and then attaches the recording paper P to the holding roller 13 by an electrostatic force of the electrostatically-charged recording paper P. The holding roller 13 holds the recording paper P where the recording paper P is attached to the holding roller 13. The holding roller 13 rotates, and thereby conveys the held recording paper P.

The image forming apparatus 16 forms an image on the recording paper P on the outer surface of the holding roller 13, the recording paper P being held by the holding apparatus 15. The image forming apparatus 16 includes the inkjet heads 21, which face the surface of the holding roller 13. The inkjet heads 21 eject four-color inks (for example, cyan, magenta, yellow, and black) toward the recording paper P, and thereby form an image on the recording paper P.

The static-eliminating and peeling apparatus 17 eliminates static electricity from the recording paper P, on which the image is formed, and thereby peels the recording paper P from the holding roller 13. Specifically, the static-eliminating and peeling apparatus 17 electrically charges the recording paper P, and thereby eliminates static electricity from the recording paper P. Further, the static-eliminating and peeling apparatus 17 includes a peeling nail (not shown), and inserts the peeling nail between the static-eliminated recording paper P and the holding roller 13. As a result, the recording paper P is peeled from the holding roller 13. The conveyer apparatus 14 conveys the recording paper P, which is peeled from the holding roller 13, to the copy receiving tray 12 or the inversing apparatus 18.

The cleaning apparatus 19 cleans the holding roller 13. The cleaning apparatus 19 is arranged at the downstream of the static-eliminating and peeling apparatus 17 in the rotational direction of the holding roller 13. The cleaning apparatus 19 includes the cleaning member 19*a*. The cleaning apparatus 19 causes the cleaning member 19*a* to come into close contact with the surface of the rotating holding roller 13, and thereby cleans the surface of the rotating holding roller 13.

In order to form images on the two sides of the recording paper P, the inversing apparatus 18 turns the recording paper P, which is peeled from the holding roller 13, upside down, and supplies the recording paper P to the surface of the holding roller 13 again. Specifically, the conveyer apparatus 14 switches back the peeled recording paper P the other way around, and thereby conveys the recording paper P to the inversing apparatus 18. The inversing apparatus 18 includes a predetermined inversion path. The inversing apparatus 18 conveys the recording paper P along the inversion path, and thereby turns the recording paper P upside down.

Figure 2:
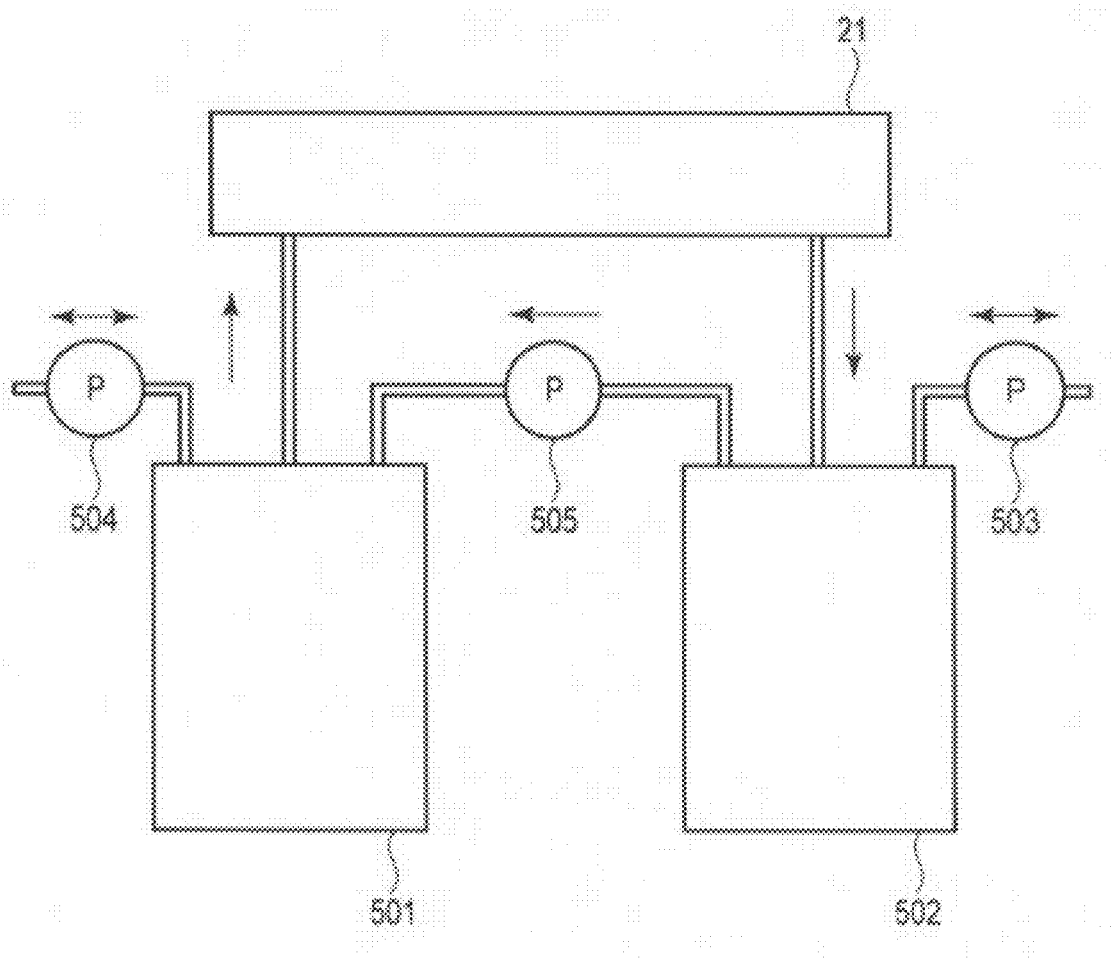
FIG. 2 is a diagram schematically showing the structure of an ink-supply system of an inkjet printer of the first embodiment.

FIG. 2 shows an ink-supply system of the inkjet printer 1. The inkjet printer 1 includes the ink tanks 501, 502, the pressure control pumps 503, 504, and the ink circulation pump 505, which are connected to each of the inkjet heads 21. Each inkjet head 21 is connected to the ink tanks 501, 502, which store ink of the corresponding color. The inkjet head 21 includes an ink inlet port (not shown) and an ink outlet port (not shown). The ink inlet port is connected to the ink tank 501, and the ink outlet port is connected to the other ink tank 502. Further, the ink tank 501, which is connected to the ink inlet port, is connected to the ink tank 502, which is connected to the ink outlet port, via the ink circulation pump 505. Thanks to this structure, the ink circulation pump 505 causes the ink in the ink tank 502, which is at the ink outlet port side, to flow into the ink tank 501, which is at the ink inlet port side.

Figure 3:
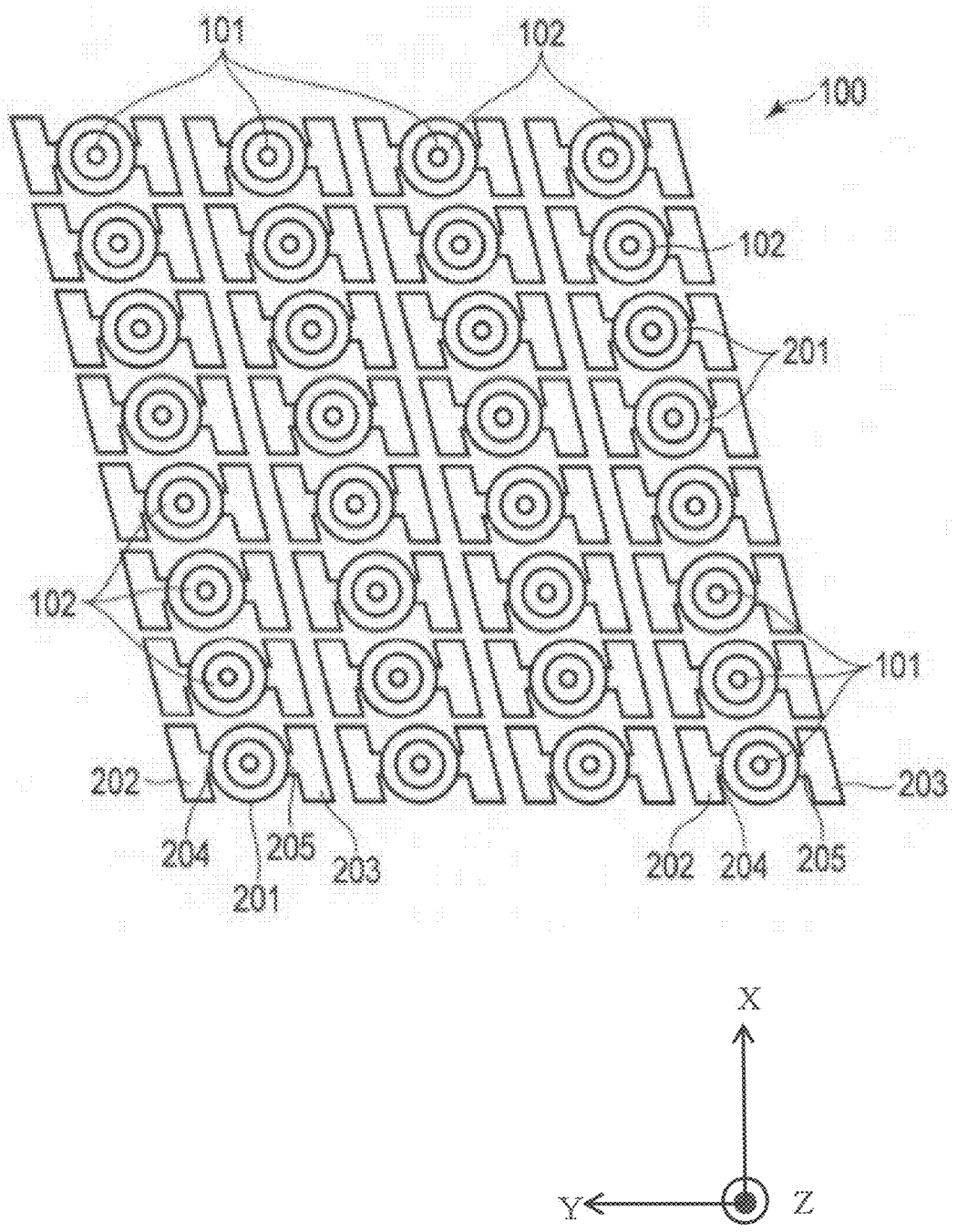
FIG. 3 is a plan view showing how pressure cells are formed and arranged on the substrate of the inkjet head of the first embodiment.
Figure 4:
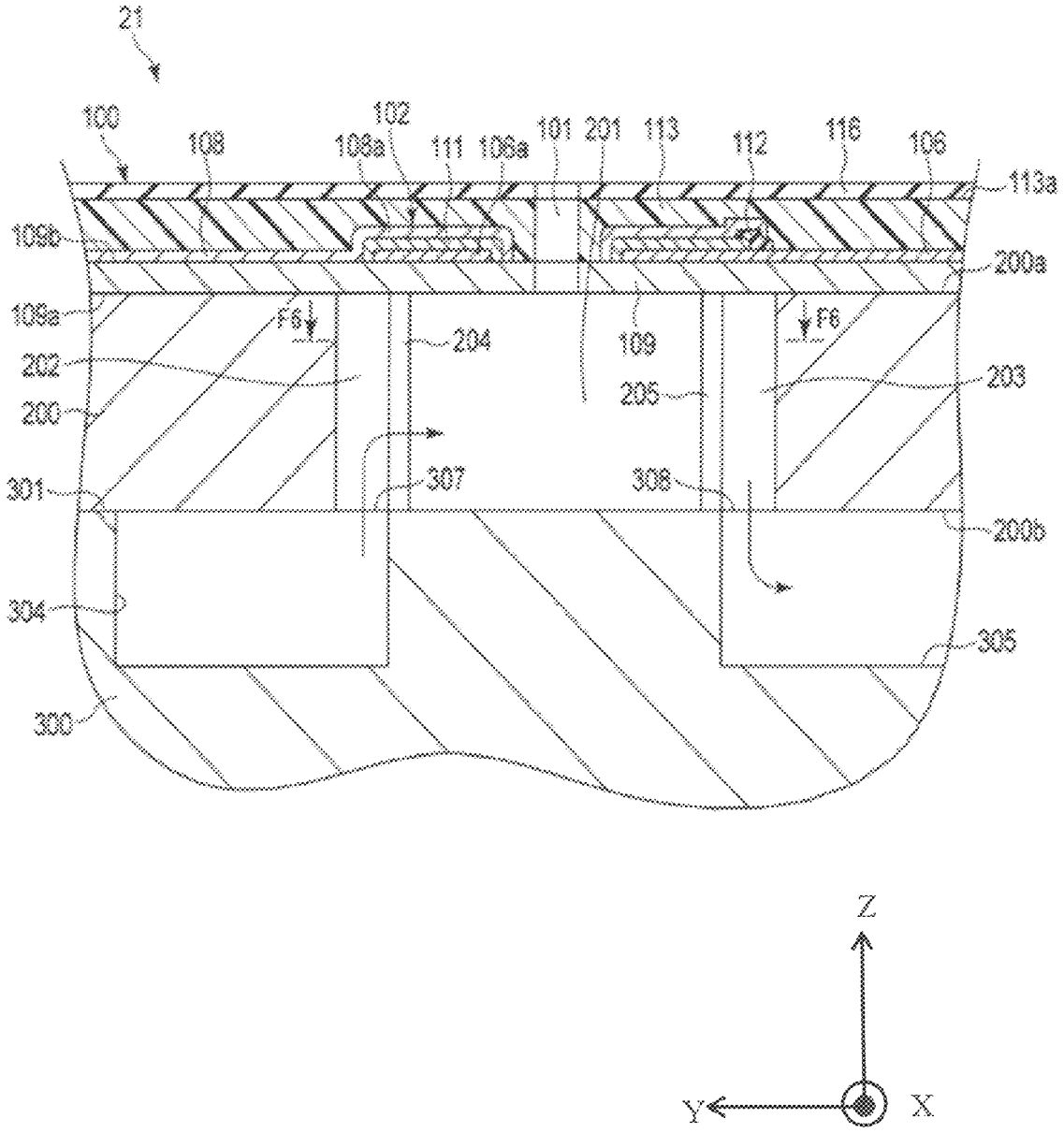
FIG. 4 is a longitudinal sectional view showing the main part of the cross sectional structure around one nozzle of the inkjet head.

Hereinafter, with reference to FIG. 3 and FIG. 4, the internal structure of one ink circulation-type inkjet head 21 of the image forming apparatus 16 will be described schematically. FIG. 3 is a plan view showing how pressure cells are formed and arranged on the substrate of the inkjet head 21. FIG. 4 is a longitudinal sectional view showing the main part of the cross sectional structure around one nozzle of the inkjet head 21. Note that, for illustrative purposes, FIGS. 3 and 4 show various elements, which are actually hidden, in solid lines. In addition, FIGS. 3 and 4 show the inkjet head 21 of this embodiment schematically. The sizes shown in FIGS. 3 and 4 may sometimes be different from those described in this embodiment.

The inkjet head 21 ejects ink drops toward the recording paper P held by the holding roller 13, and thereby forms texts and images thereon. As shown in FIG. 4, the inkjet head 21 includes the nozzle plate 100, the pressure cell structure 200, and the ink flow path structure 300. The pressure cell structure 200 is an example of the substrate.

The nozzle plate 100 has a rectangular plate shape. The nozzle plate 100 is formed on the pressure cell structure 200, the nozzle plate 100 and the pressure cell structure 200 being an assembly. The nozzle plate 100 includes the nozzles (orifices, ink ejecting holes) 101 and the actuators 102.

The nozzles 101 are circular holes. The diameter of the nozzle 101 is, for example, 20 μm. As shown in FIG. 3, the nozzles 101 are arrayed in the longer-side direction (horizontal direction of FIG. 3) and the shorter-side direction (vertical direction of FIG. 3) of the nozzle plate 100. In other words, the nozzles 101 are arranged in matrix. The nozzles 101 are arranged such that the nozzles 101 in one line are spaced apart from the nozzles 101 in the next line in the longer-side direction of the nozzle plate 100. According to this structure, the actuators 102 are arranged in a higher density.

The distance between the center of one nozzle 101 and the center of the next nozzle 101, the nozzles 101 being adjacent to each other in the longer-side direction of the nozzle plate 100, is 340 μm, for example. The distance between the center of one line of the nozzles 101 and the center of the next line of the nozzles 101, the lines being adjacent to each other in the shorter-side direction of the nozzle plate 100, is 240 μm, for example.

The actuators 102 are arranged corresponding to the nozzles 101 one to one. As shown in FIG. 3, the actuator 102 and the corresponding nozzle 101 are arranged coaxially. The actuator 102 has an annular shape, and surrounds the corresponding nozzle 101. Alternatively, the actuator 102 may have a semi-open annular shape (C shape), for example.

The pressure cell structure 200 is made of a silicon wafer, and has a rectangular plate shape. Alternatively, the pressure cell structure 200 may be another semiconductor such as a silicon carbide (SiC) substrate and a germanium substrate, for example. Alternatively, the substrate (the pressure cell structure 200) may be made of another material such as ceramics, glass, quartz, resin, and metal. Ceramics such as, for example, nitride, carbide, and oxide such as alumina ceramics, zirconia, silicon carbide, silicon nitride, and barium titanate is used. Resin such as, for example, a plastic material such as ABS (acrylonitrile butadiene styrene), polyacetal, polyamide, polycarbonate, and polyethersulfone is used. Metal such as, for example, aluminum and titanium is used. The thickness of the pressure cell structure 200 is, for example, 725 μm. The thickness of the pressure cell structure 200 is preferably, for example, in the range of 100 to 775 μm.

As shown in FIG. 4, the pressure cell structure 200 includes the first end surface 200*a*, the second end surface 200*b*, and the pressure cells (ink cells) 201. The first and second end surfaces 200*a*, 200*b* are flat. The second end surface 200*b* is opposite to the first end surface 200*a*. The nozzle plate 100 is fixed to the first end surface 200*a*.

The pressure cells 201 are circular holes. The diameter of the pressure cell 201 is, for example, 190 μm. Note that the shape of the pressure cell 201 is not limited to this. The pressure cell 201 penetrates through the pressure cell structure 200 in its thickness direction, and has an opening through the first end surface 200*a* and an opening through the second end surface 200*b*. The nozzle plate 100 covers the pressure cells 201 having the openings through the first end surface 200*a*.

The pressure cells 201 are arranged corresponding to the nozzles 101 one to one. In other words, the pressure cell 201 and the corresponding nozzle 101 are arranged coaxially. According to this structure, the pressure cell 201 is in communication with the corresponding nozzle 101. The pressure cell 201 is in communication with the outside of the inkjet head 21 via the nozzle 101.

Next, the nozzle plate 100 will be described.

As shown in FIG. 3 and FIG. 4, the nozzle plate 100 includes the above-mentioned nozzles 101 and actuators 102, the shared electrode 106, the wiring electrodes 108, the vibration plate 109, the protective film (insulation film) 113, and the ink-repellent film 116. The shared electrode 106 is an example of a first electrode (common electrode). The wiring electrode 108 is an example of a second electrode (individual electrode). The nozzle 101 penetrates through the vibration plate 109 and the protective film 113, the vibration plate 109 being layered on the first end surface 200*a* of the pressure cell structure 200, the protective film 113 being layered on the vibration plate 109.

The vibration plate 109 is formed on the first end surface 200*a* of the pressure cell structure 200, and has a rectangular plate shape. The thickness of the vibration plate 109 is, for example, 2 μm. Preferably, the thickness of the vibration plate 109 is in the range of 1 μm to 50 μm, approximately. The protective film 113 is an example of an insulator.

The vibration plate 109 is, for example, an $SiO_2$ (silicon dioxide) film formed on the first end surface 200*a* of the pressure cell structure 200, and has a rectangular plate shape. In other words, the vibration plate 109 is an oxide film of the pressure cell structure 200, which is a silicon wafer. The vibration plate 109 may be made of another material such as single-crystal Si (silicon), $Al_2O_3$ (aluminum oxide), $HfO_2$ (hafnium oxide), $ZrO_2$ (zirconium oxide), and DLC (Diamond Like Carbon).

The vibration plate 109 includes the first surface 109*a* and the second surface 109*b*. The first surface 109*a* is fixed to the first end surface 200*a* of the pressure cell structure 200, and covers the pressure cell 201. The second surface 109*b* is opposite to the first surface 109*a*. The actuator 102, the shared electrode 106, and the wiring electrode 108 are arranged on the second surface 109*b* of the vibration plate 109.

As shown in FIG. 4, each actuator 102 includes the piezoelectric film 111, the electrode part 106*a* of the shared electrode 106, the electrode part 108*a* of the wiring electrode 108, and the insulation film 112. The piezoelectric film 111 is an example of a piezoelectric member.

The piezoelectric film 111 is a film made of lead zirconium titanate (PZT). Alternatively, the piezoelectric film 111 may be made of any one of various materials such as, for example, PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN.

The piezoelectric film 111 has an annular shape. The piezoelectric film 111 is arranged coaxially with the nozzle 101 and the pressure cell 201. The piezoelectric film 111 surrounds the nozzle 101. The outer diameter of the piezoelectric film 111 is, for example, 144 μm. The inner diameter of the piezoelectric film 111 is, for example, 30 μm.

The thickness of the piezoelectric film 111 is, for example, 2 μm. The thickness of the piezoelectric film 111 is determined based on its piezoelectric property, dielectric breakdown voltage, and the like. The thickness of the piezoelectric film 111 is preferably in the range of 0.1 μm to 5 μm, approximately.

The piezoelectric film 111 is arranged between the electrode part 108*a* of the wiring electrode 108 and the electrode part 106*a* of the shared electrode 106. In other words, the electrode part 108*a* of the wiring electrode 108 is formed on one side of the piezoelectric film 111, and the electrode part 106*a* of the shared electrode 106 is formed on the other side of the piezoelectric film 111.

The piezoelectric film 111 is polarized in the thickness direction (Z direction) at the time when the film is formed. In other words, for example, the piezoelectric film 111 is polarized, the side on the electrode part 106*a* being positive, the side of the piezoelectric film 111 on the electrode part 108*a* being negative.

Drive voltage is applied to the electrode parts 106*a*, 108*a* of the shared electrode 106 and the wiring electrodes 108. When the drive voltage is applied, the electric field in the thickness direction (Z direction) of the piezoelectric film 111 is applied to the polarized piezoelectric film 111. At this time, the piezoelectric film 111 expands or contracts in the electric field direction (Z direction), and contracts or expands in the direction (X, Y directions) perpendicular to the electric field direction, at the same time. As a result, the actuator 102, which includes the piezoelectric film 111, expands or contracts in the electric field direction (Z direction) and contracts or expands in the direction (X, Y directions) perpendicular to the electric field direction, at the same time. When the actuators 102 expands and contracts, the vibration plate 109 deforms in the thickness direction (Z direction) of the nozzle plate 100. As a result, the pressure of the ink in the pressure cell 201 is changed.

The electrode part 108*a* of the wiring electrode 108 is one of the two electrodes connected to the piezoelectric film 111. The electrode part 108*a* of the wiring electrode 108 has an annular shape larger than the piezoelectric film 111, and is at the ejection side (external side of the inkjet head 21) of the piezoelectric film 111. The outer diameter of the electrode part 108*a* is, for example, 148 μm. The inner diameter of the electrode part 108*a* is, for example, 26 μm. In other words, the inner peripheral part of the electrode part 108*a* is apart from the nozzle 101.

The electrode part 106*a* of the shared electrode 106 is the other of the two electrodes connected to the piezoelectric film 111. The electrode part 106*a* of the shared electrode 106 has an annular shape smaller than the piezoelectric film 111, and is arranged on the second surface 109*b* of the vibration plate 109. The outer diameter of the electrode part 106*a* is, for example, 140 μm. The inner diameter of the electrode part 106*a* is, for example, 34 μm.

The insulation film 112 is outside of the area in which the piezoelectric film 111 is formed, and is interposed between the shared electrode 106 and the wiring electrode 108. In other words, the shared electrode 106 is separated from the wiring electrode 108, the piezoelectric film 111 or the insulation film 112 being interposed therebetween. The insulation film 112 is made of, for example, $SiO_2$. The insulation film 112 may be made of another insulation material. The thickness of the insulation film 112 is, for example, 0.2 μm.

A wiring electrode terminal unit (not shown) is arranged at the end of the wiring electrode 108. The wiring electrode terminal unit is connected to a controller (not shown) via a flexible cable, for example, and transmits signals output from the controller to drive the actuator 102.

A shared electrode terminal unit (not shown) is arranged on the second surface 109*b* of the vibration plate 109. The shared electrode terminal unit is at the end of the shared electrode 106, and is connected to GND (grounded=0 V), for example.

The wiring electrode 108 is connected to the piezoelectric film 111 of the corresponding actuator 102 one to one, and transmits signals to drive the actuator 102. The wiring electrode 108 is an individual electrode that drives the piezoelectric film 111 independently. Each of the wiring electrodes 108 includes the electrode part 108*a*, a wiring part, and the wiring electrode terminal unit.

The wiring part of the wiring electrode 108 extends from the electrode part 108*a* to the wiring electrode terminal unit. The electrode part 108*a* of the wiring electrode 108 and the nozzle 101 are arranged coaxially. The inner peripheral part of the electrode part 108*a* is slightly apart from the nozzle 101.

The wiring electrodes 108 are thin films made of Pt (platinum). Note that the wiring electrodes 108 may be made of another material such as Ni (nickel), Cu (copper), Al (aluminum), Ag (silver), Ti (titanium), W (tantalum), Mo (molybdenum), and Au (gold). The thickness of the wiring electrode 108 is, for example, 0.5 μm. Preferably, the film thickness of the wiring electrodes 108 is from 0.01 μm to 1 μm, approximately.

The shared electrode 106 is connected to the piezoelectric films 111. The shared electrode 106 includes the electrode parts 106*a*, wiring parts, and two shared electrode terminal units. The wiring parts of the shared electrode 106 extend from the electrode parts 106*a* to the opposite sides of the wiring parts of the wiring electrodes 108. The wiring parts of the shared electrode 106 join together at the end of the nozzle plate 100 in the Y direction, and extend along both the edges of the nozzle plate 100 in the X direction. The electrode part 106*a* and the nozzle 101 are arranged coaxially. The shared electrode terminal units are arranged at both the edges of the nozzle plate 100 in the X direction.

The shared electrode 106 is made of a Pt (platinum)/Ti (titanium) thin film. The shared electrode 106 may be made of another material such as Ni, Cu, Al, Ti, W, Mo, and Au. The thickness of the shared electrode 106 is, for example, 0.5 μm. The thickness of the shared electrode 106 is approximately 0.01 to 1 μm, preferably.

The width of the wiring part of the wiring electrode 108 is 80 μm, and the width of the wiring part of the shared electrode 106 is 80 μm, for example. The wiring parts of some of the wiring electrodes 108 pass through two adjacent actuators 102.

As shown in FIG. 4, the protective film 113 is arranged on the second surface 109*b* of the vibration plate 109. The protective film 113 is made of, for example, insulating polyimide. Alternatively, the protective film 113 may be made of another material such as resin, ceramics, and metal (alloy). Resin such as, for example, a plastic material such as ABS (acrylonitrile butadiene styrene), polyacetal, polyamide, polycarbonate, and polyethersulfone is used. Ceramics such as, for example, nitride, carbide, and oxide such as zirconia, silicon carbide, silicon nitride, and barium titanate is used. Metal such as, for example, aluminum, SUS, and titanium is used.

The Young's modulus of the material of the protective film 113 is largely different from the Young's modulus of the material of the vibration plate 109. The deformation amount of a member having a plate shape is affected by the Young's modulus of the material and the thickness of the plate. The smaller the Young's modulus and the smaller the thickness of a plate, the larger the deformation amount of the plate when a force is applied constantly. The vibration plate 109 is made of $SiO_2$, the Young's modulus thereof being 80.6 GPa. The protective film 113 is made of polyimide, the Young's modulus thereof being 4 GPa. The difference between the Young's modulus of the vibration plate 109 and the Young's modulus of the protective film 113 is 76.6 GPa.

The thickness of the protective film 113 is, for example, 4 μm. Preferably, the thickness of the protective film 113 is approximately in the range of 1 μm to 50 μm. The protective film 113 covers the second surface 109*b* of the vibration plate 109, the shared electrode 106, the wiring electrode 108, and the piezoelectric film 111.

The ink-repellent film 116 covers the surface 113*a* of the protective film 113. The ink-repellent film 116 is made of a silicon-series liquid-repellent material having liquid repellency. Note that the ink-repellent film 116 may be made of another material such as a fluorinated organic material. The thickness of the ink-repellent film 116 is, for example, 1 μm. The ink-repellent film 116 does not cover but exposes the protective film 113 around the shared electrode terminal unit and the wiring electrode terminal unit.

As shown in FIG. 4, the ink flow path structure 300 includes the fixing surface 301, the ink supply flow paths 304, and the ink recovery flow paths 305. The ink flow path structure 300 is made of, for example, stainless steel, and has a rectangular plate shape. The thickness of the ink flow path structure 300 is, for example, 4 mm. The fixing surface 301 of the ink flow path structure 300 is bonded to the second end surface 200*b* of the pressure cell structure 200 with, for example, epoxy-based adhesive.

The ink flow path structure 300 may not be made of stainless steel. The ink flow path structure 300 may be made of any other material such as ceramics, resin, and metal (alloy) as long as the pressure is not increased to eject the ink, in consideration of the difference between the expansion coefficient of the ink flow path structure 300 and the expansion coefficient of the nozzle plate 100. Ceramics such as, for example, nitride and oxide such as alumina ceramics, zirconia, silicon carbide, silicon nitride, and barium titanate is used. Resin such as, for example, a plastic material such as ABS, polyacetal, polyamide, polycarbonate, and polyethersulfone is used. Metal such as, for example, aluminum and titanium is used.

An ink inlet port (not shown) is arranged at one end of the ink flow path structure 300. The ink inlet port is connected to the ink tank 501 via a path such as a tube, for example. For example, the pressure control pump 504 supplies the ink stored in the ink tank 501 to the ink inlet port.

An ink recovery port (not shown) is arranged at the other end of the ink flow path structure 300. The ink inlet port and the ink recovery port may not be arranged at both the ends of the ink flow path structure 300. For example, both the ink inlet port and the ink recovery port may be arranged at one end of the ink flow path structure 300, or may be arranged at the center of the ink flow path structure 300.

The ink recovery port is connected to the ink tank 502 via a path such as a tube, for example. For example, the pressure control pump 503 recovers the ink flowing into the ink recovery port, in the ink tank 502.

Figure 5:
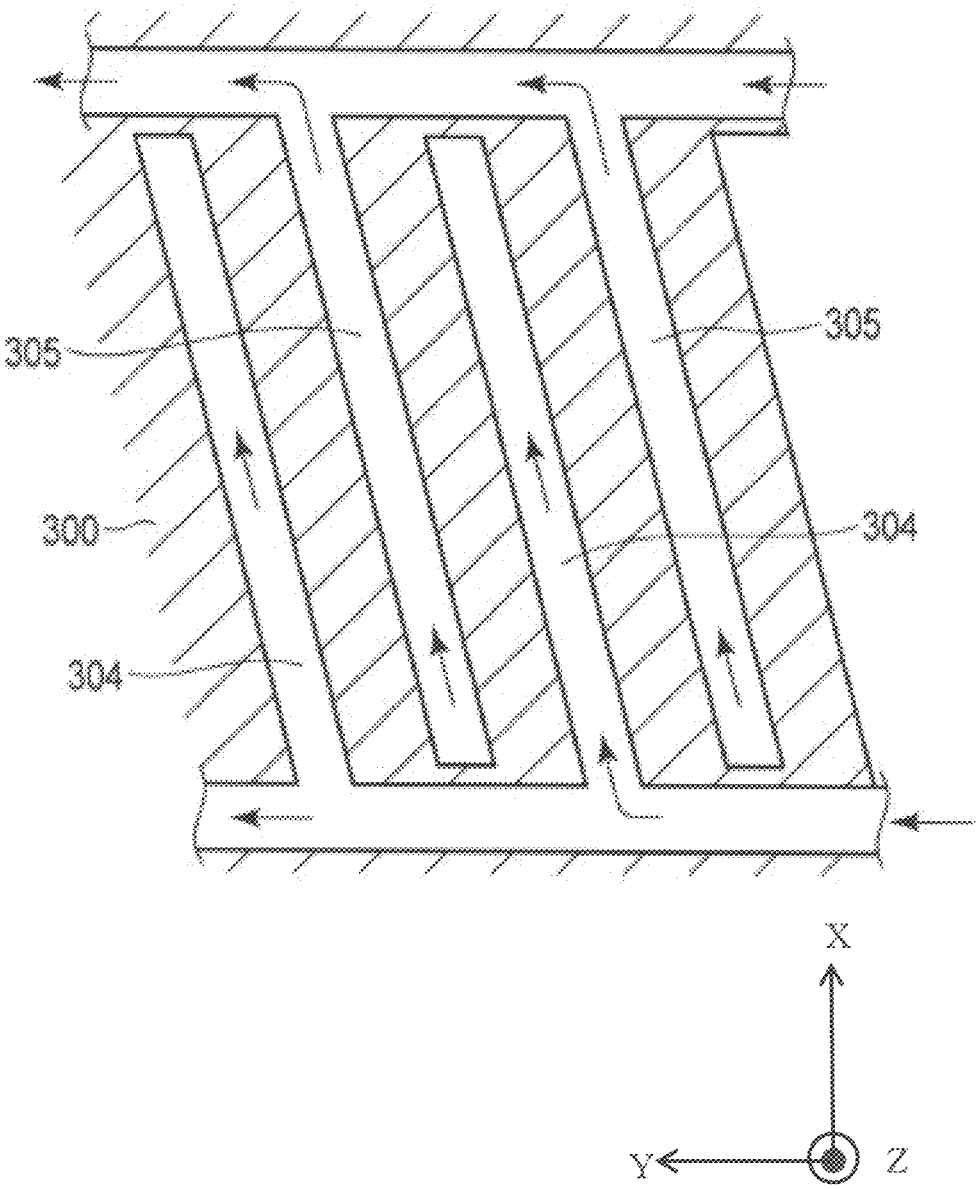
FIG. 5 is a cross sectional view showing the main part of the ink supply member of the inkjet head of the first embodiment.

As shown in FIG. 5, the ink supply flow paths 304 are grooves on the fixing surface 301. The ink supply flow paths 304 extend in parallel in a predetermined direction. The depth of the ink supply flow path 304 is, for example, 1 mm. One end of the ink supply flow path 304 is connected to the ink inlet port. According to this structure, ink, which is supplied from the ink tank 501 to the ink inlet port, flows into the ink supply flow path 304.

The ink recovery flow paths 305 are grooves on the fixing surface 301. As shown in FIG. 5, each ink recovery flow path 305 is arranged between each two ink supply flow paths 304. The ink recovery flow paths 305 extend in parallel with the ink supply flow paths 304 in the predetermined direction. The depth of the ink recovery flow path 305 is, for example, 1 mm. One end of the ink recovery flow path 305 is connected to the ink recovery port. According to this structure, ink, which is flowed into the ink recovery flow path 305, is recovered in the ink tank 502 via the ink recovery port.

Figure 6:
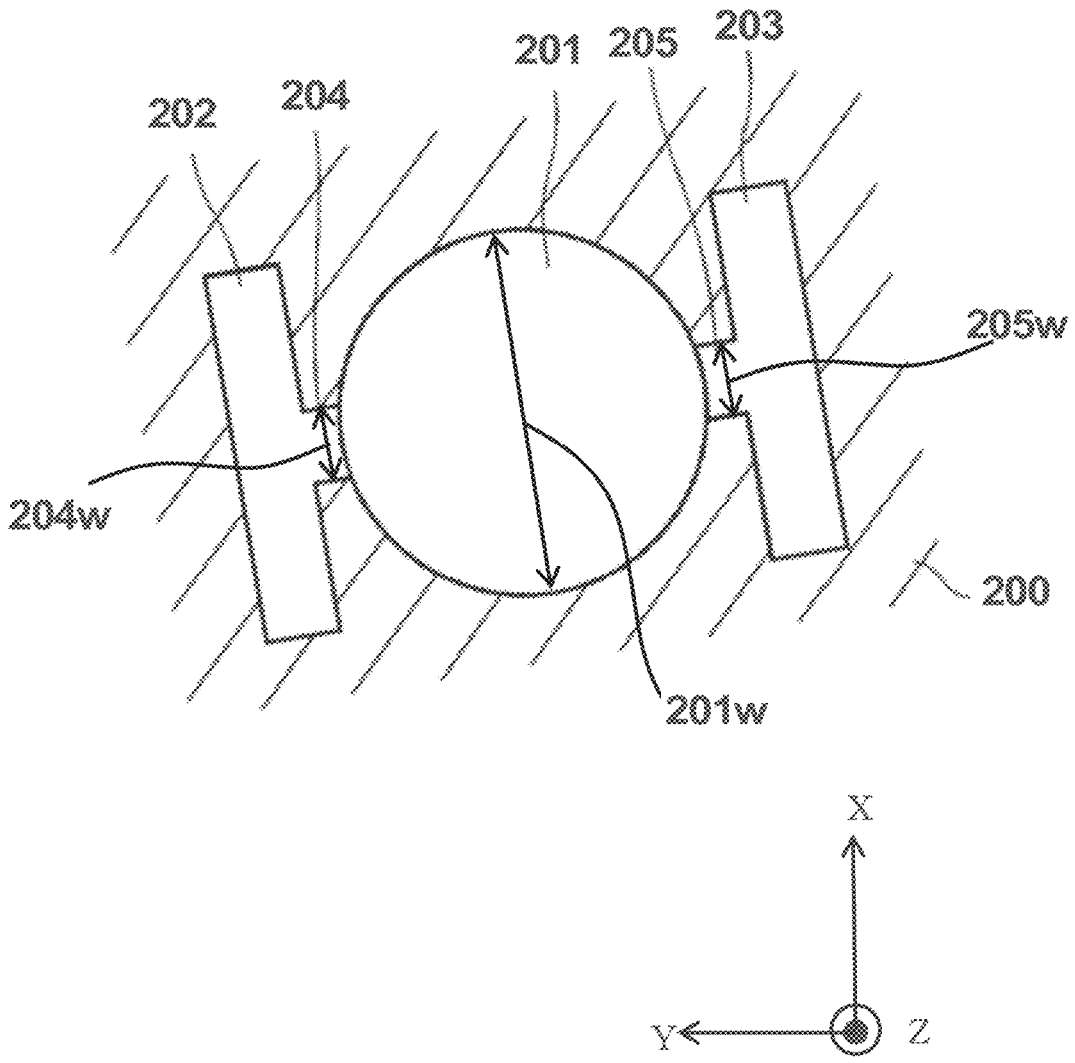
FIG. 6 is a cross sectional view in the F6-F6 line of FIG. 4.

In this embodiment, as shown in FIG. 3, FIG. 4, and FIG. 6, the pressure cell structure 200 includes the flow control paths 202, 203 and the slits 204, 205. The flow control paths 202, 203 and the slits 204, 205 control ink flowing into the pressure cell 201. The flow control path 202 and the slit 204 are at one side of the pressure cell 201, and the flow control path 203 and the slit 205 are at the other side of the pressure cell 201, the pressure cell 201 being interposed therebetween. Each of the flow control paths 202, 203 corresponds to each pressure cell 201, is an approximately rectangular long through hole, and is formed from the first end surface 200*a* of the pressure cell structure 200 to the second end surface 200*b* thereof in the thickness direction of the pressure cell structure 200.

The slit 204 is formed between the flow control path 202 at one side of the pressure cell 201 and the pressure cell 201. Similarly, the slit 205 is formed between the flow control path 203 at the other side of the pressure cell 201 and the pressure cell 201. Each of the slits 204, 205 is a narrow groove, and is formed from the first end surface 200*a* of the pressure cell structure 200 to the second end surface 200*b* thereof in the thickness direction of the pressure cell structure 200. The slit 204 is in communication with the pressure cell 201 and the flow control path 202, the slit 205 is in communication with the pressure cell 201 and the flow control path 203, and the width of each slit 204, 205 is smaller than the width of the pressure cell 201. In this case, the width of each slit 204, 205 is, for example, the width 204*w*, 205*w* of FIG. 6. The width of the pressure cell 201 is the width 201*w* (diameter of pressure cell) of FIG. 6. In other words, the width 204*w*, 205*w* is the width of each slit 204, 205 in the direction slightly inclined from X direction to Y direction. In other words, similarly, the width 201*w* is the width of the pressure cell 201 in the direction inclined. Note that, in FIG. 3, the nozzles 101 are arrayed in the direction inclined. Further, in FIG. 5, the ink supply flow paths 304 and the ink recovery flow paths 305 are arrayed in the direction inclined. Note that, preferably, the width of each slit 204, 205 is the same as the width of the nozzle 101 (diameter of nozzle).

As shown in FIG. 4, the ink flow path structure 300 includes the first connection ports 307 and the second connection ports 308. The first connection ports 307 are in communication with the ink supply flow paths 304. The second connection ports 308 are in communication with the ink recovery flow paths 305. The first and second connection ports 307, 308 are formed by bonding the pressure cell structure 200 and the ink flow path structure 300. As shown in FIG. 4, the end of the flow control path 202 and the end of the ink supply flow path 304 form the first connection port 307. Further, the end of the flow control path 203 and the end of the ink recovery flow path 305 form the second connection port 308. The end of the ink supply flow path 304, which forms the first connection port 307, is in parallel with the end of the ink recovery flow path 305, which forms the second connection port 308.

Further, the first connection ports 307 are in communication with the flow control paths 202, and the second connection ports 308 are in communication with the flow control paths 203. Here, each first connection port 307 is in communication with each flow control path 202 of the pressure cell structure 200. Similarly, each second connection port 308 is in communication with each flow control path 203 of the pressure cell structure 200.

With this structure, ink flows into the ink supply flow path 304, passes through the first connection port 307, and flows into the flow control path 202 of the pressure cell structure 200. Then, the ink flows from the flow control path 202, passes through the slit 204, and flows into the pressure cell 201. Then, the ink in the pressure cell 201 passes through the slit 205, flows into the flow control path 203 side, passes through the second connection port 308, and flows into the ink recovery flow path 305.

Next, how the piezoelectric film 111 of the actuator 102 works will be described further. As described above, the piezoelectric film 111 expands or contracts in the film thickness direction (Z direction), and contracts or expands in the direction (in-plane direction, X, Y directions) perpendicular to the film thickness direction.

In the following description, expansion and contraction of the piezoelectric film 111 only in the in-plane direction will be described, and expansion of the piezoelectric film 111 in the film thickness direction will not be described.

When the piezoelectric film 111 contracts in the in-plane direction (X, Y directions), the actuator 102 including the piezoelectric film 111 deforms (bends) in the direction apart from the pressure cell 201. In other words, the actuator 102 deforms (bends) in the direction in which the volume of the pressure cell 201 is increased. As a result, when the actuator 102 bends as described above, the vibration plate 109, which is connected to the piezoelectric film 111, bends in the direction in which the volume of the pressure cell 201 is increased. When the vibration plate 109 bends in the direction in which the volume of the pressure cell 201 is increased, negative pressure is applied to the ink retained in the pressure cell 201. When the negative pressure is applied, the ink flows from the ink flow path structure 300 into the flow control path 202 of the pressure cell structure 200. Further, the ink in the flow control path 202 passes through the slit 204, and is supplied to the pressure cell 201.

When the piezoelectric film 111 expands in the in-plane direction, the actuator 102 deforms (bends) in the direction toward the pressure cell 201. In other words, the actuator 102 bends in the direction in which the volume of the pressure cell 201 is decreased. As a result, when the actuator 102 bends as described above, the vibration plate 109, which is connected to the piezoelectric film 111, bends in the direction in which the volume of the pressure cell 201 is decreased. When the vibration plate 109 bends in the direction in which the volume of the pressure cell 201 is decreased, positive pressure is applied to the ink retained in the pressure cell 201. When the positive pressure is applied, ink drops are ejected from the nozzle 101. The ink is ejected in Z direction. When the volume of the pressure cell 201 is decreased, part of the vibration plate 109 near the nozzle 101 deforms in the direction of the ejection of the ink, because the piezoelectric film 111 deforms (expands in in-plane direction). In other words, the actuator 102 works in the bending mode to eject ink.

The inkjet head 21 performs printing (forms images) as follows, for example. Ink is supplied from the ink tank 501 to the ink inlet port of the ink flow path structure 300.

The ink passes through the ink supply flow path 304 and the first connection port 307, and flows into the flow control path 202 of the pressure cell structure 200. Further, the ink in the flow control path 202 passes through the slit 204, and is supplied to the pressure cell 201. The ink supplied to the pressure cell 201 is supplied to the corresponding nozzle 101, and forms a meniscus on the nozzle 101. In the inkjet printer 1, the pressure control pumps 503, 504 control the pressure of the ink supplied from the ink inlet port to obtain an appropriate negative pressure, and the ink is thereby kept in the nozzle 101 such that the ink may not leak from the nozzle 101.

For example, in response to an operation from a user, a print instruction signal is input in a controller (not shown). In response to the printing instruction, the controller outputs the signal to the actuator 102 via the wiring electrode 108. In other words, the controller applies a drive voltage to the electrode part 108*a* of the wiring electrode 108. As a result, an electric field in the film thickness direction (Z direction) is applied to the piezoelectric film 111, and the piezoelectric film 111 expands and contracts as described above. Then the actuator 102 bends as described above.

The actuator 102 is sandwiched between the vibration plate 109 and the protective film 113. With this structure, when the piezoelectric film 111 expands in X, Y directions and the actuator 102 bends, a force is applied to the vibration plate 109, and the vibration plate 109 deforms in a concave shape in the direction toward the pressure cell 201 side. To the contrary, a force is applied to the protective film 113, and the protective film 113 deforms in a convex shape in the direction toward the pressure cell 201 side.

When the piezoelectric film 111 contracts in X, Y directions and the actuator 102 bends, a force is applied to the vibration plate 109, and the vibration plate 109 deforms in a convex shape in the direction toward the pressure cell 201. To the contrary, a force is applied to the protective film 113, and the protective film 113 deforms in a concave shape in the direction toward the pressure cell 201.

The Young's modulus of a polyimide film, which forms the protective film 113, is smaller than the Young's modulus of an $SiO_2$ film, which forms the vibration plate 109. Because of this, when the same amount of force is applied to the protective film 113 and the vibration plate 109, the protective film 113 deforms larger than the vibration plate 109. When the piezoelectric film 111 of the actuator 102 expands in X, Y directions, the nozzle plate 100 deforms in a convex shape in the direction toward the pressure cell 201 side. As a result, the volume of the pressure cell 201 is decreased (because the deformation amount of the protective film 113 in a convex shape in the direction toward the pressure cell 201 is larger).

To the contrary, when the piezoelectric film 111 of the actuator 102 contracts in X, Y directions, the nozzle plate 100 deforms in a concave shape in the direction toward the pressure cell 201 side. As a result, the volume of the pressure cell 201 is increased (because the deformation amount of the protective film 113 in a concave shape in the direction toward the pressure cell 201 is larger).

When the vibration plate 109 deforms and the volume of the pressure cell 201 is changed, the pressure of the ink in the pressure cell 201 is changed. When the pressure is changed, the ink in the nozzle 101 is ejected. At this time, the slits 204, 205 control the ink pressurized in the pressure cell 201 such that the ink may not flow into the flow control paths 202, 203. The slits 204, 205 thereby prevent the volume and the ejection speed of the ink ejected from the nozzle 101 from being decreased.

The larger the difference between the Young's modulus of the vibration plate 109 and the Young's modulus of the protective film 113, the larger the deformation amount of the vibration plate 109 when a predetermined voltage is applied to the actuator 102. Because of this, the larger the difference between the Young's modulus of the vibration plate 109 and the Young's modulus of the protective film 113, the lower the voltage of the ink ejection.

If the film thickness and the Young's modulus of the vibration plate 109 are the same as those of the protective film 113, when voltage is applied to the actuator 102, the same amount of forces are applied to the vibration plate 109 and the protective film 113, and the plate 109 and the protective film 113 thereby deform in the opposite directions by the same amount. As a result, the vibration plate 109 does not deform.

Note that, as described above, not only the Young's modulus of the material but also the thickness of the plate affects the deformation amount of the plate member. In view of this, in order to make the deformation amount of the vibration plate 109 and the deformation amount of the protective film 113 different, not only the Young's moduli of the materials but also the thicknesses of films are considered. Even if the Young's modulus of the material of the vibration plate 109 is the same as that of the protective film 113, if the thickness of one film is different from that of the other, it is possible to eject ink, which requires the higher drive voltage, though.

The ink outlet port is an opening at the end of the ink recovery flow path 305. The ink outlet port is connected to the ink tank 502 via a tube, for example. The ink, which is not ejected from the nozzle 101, flows from the pressure cell 201, passes through the slit 205, the flow control path 203, the second connection port 308, the ink recovery flow path 305, and the ink outlet port, and is discharged to the ink tank 502. As described above, the ink circulates in the ink tank 501, the ink supply flow path 304, the flow control path 202, the pressure cells 201, the flow control path 203, the ink recovery flow path 305 the ink tank 502, and the ink circulation pump 505. Because the ink circulates, the temperature of the inkjet head 21 and the temperature of the ink are kept constant, and the quality of the ink is less changed affected by heat, for example.

Next, an example of a method of manufacturing the inkjet head 21 will be described. First, before forming the pressure cells 201, the flow control paths 202, 203, and the slits 204, 205, an $SiO_2$ film is formed as the vibration plate 109 on the entire area of the first end surface 200*a* of the pressure cell structure 200 (silicon wafer). The $SiO_2$ film is formed by a thermally-oxidized film-forming method, for example. Note that the $SiO_2$ film may be formed by using another method such as a CVD method.

A silicon wafer, from which the pressure cell structure 200 is formed, is one large circular plate. The pressure cell structures 200 are cut out from the silicon wafer later. Alternatively, one pressure cell structure 200 may be one rectangular silicon wafer.

The silicon wafer is repeatedly heated and thin films are formed when the inkjet head 21 is manufactured. In view of this, the silicon wafer is heat-resistant, complies with SEMI (Semiconductor Equipment and Materials International) standard, and is mirror-polished and smoothed.

Next, a metal film as the shared electrode 106 is formed on the second surface 109*b* of the vibration plate 109. First, Ti and Pt are sputtered, and Ti and Pt films are formed in order. The film thickness of Ti is, for example, 0.45 μm. The film thickness of Pt is, for example, 0.05 μm. Note that the metal films may be formed by another method such as vapor deposition and metal plating.

After the metal film is formed, the shared electrode 106 is formed by patterning. An etching mask is formed on the electrode film, part of the electrode material uncovered by the etching mask is etched and removed, and the shared electrode 106 is thereby patterned.

Because the nozzle 101 is formed at the center of each electrode part 106*a* of the shared electrode 106, a portion without the electrode film is formed, the portion and the electrode part 106*a* being concentric, the center of the portion and the center of the electrode part 106*a* being the same. After the shared electrode 106 is patterned, the vibration plate 109 is exposed except for the electrode part 106*a*, wiring part, and the shared electrode terminal unit of the shared electrode 106.

Next, the piezoelectric film 111 is formed on the shared electrode 106. The piezoelectric film 111 is formed by, for example, an RF magnetron sputtering method at the substrate temperature 350° C. After the piezoelectric film 111 is formed, the piezoelectric film 111 is heated at 500° C. for 3 hours in order to apply piezoelectricity. As a result, the piezoelectric film 111 obtains good piezoelectricity. The piezoelectric film 111 may be formed by another method such as, for example, CVD (chemical vapor deposition), a sol-gel method, an AD method (aerosol deposition method), and a hydrothermal synthesis method. After the piezoelectric film 111 is formed, it is etched and patterned.

Because the nozzle 101 is formed at the center of the piezoelectric film 111, a portion without the piezoelectric film is formed, the portion and the piezoelectric film 111 being concentric. The vibration plate 109 is exposed except for the piezoelectric film 111. The piezoelectric film 111 covers the electrode part 106*a* of the shared electrode 106.

Next, the insulation film 112 is formed on part of the piezoelectric film 111 and part of the shared electrode 106. The insulation film 112 is formed by the CVD method, which realizes a good insulation properties at a low temperature. The insulation film 112 is formed and then patterned. The insulation film 112 covers only part of the piezoelectric film 111 in order to reduce troubles resulting from non-uniform patterning. The insulation film 112 covers the piezoelectric film 111 so as not to reduce the deformation amount of the piezoelectric film 111.

Next, a metal film is formed on the vibration plate 109, the piezoelectric film 111, and the insulation film 112 to form the wiring electrodes 108. The metal film is formed by a sputtering method. The metal film may be formed by another method such as a vacuum vapor deposition and a metal plating.

The metal film is patterned, and the wiring electrodes 108 are thereby formed. An etching mask is formed on the electrode film, part of the electrode material uncovered by the etching mask is etched and removed, and the wiring electrodes 108 are thereby patterned.

Because the nozzle 101 is formed at the center of the electrode part 108*a* of the wiring electrode 108, a portion without the electrode film is formed, the portion and the electrode part 108*a* of the wiring electrode 108 being concentric, the center of the portion and the center of the electrode part 108*a* being the same. The electrode part 108*a* of the wiring electrode 108 covers the piezoelectric film 111.

Next, the $SiO_2$ film of the vibration plate 109 is patterned, and part of the nozzle 101 is thereby formed. An etching mask is formed on the $SiO_2$ film, part of the $SiO_2$ film uncovered by the etching mask is etched and removed, and part of the nozzle 101 is thereby patterned.

The etching mask is formed as follows. The vibration plate 109 is coated with a photosensitive resist, then prebaked, exposed with light where it is covered with a mask on which a desired pattern is formed, developed, and postbaked.

Next, the protective film 113 is formed on the second surface 109*b* of the vibration plate 109 by a spin coating method. The protective film 113 may be formed by another method such as, for example, CVD, vacuum vapor deposition, and metal plating.

Next, the protective film 113 is patterned, and the nozzles 101 are thereby formed. Holes are formed through the protective film 113, the holes being in communication with part of the nozzles 101 through the vibration plate 109, and the nozzles 101 are thereby formed. Further, by patterning the protective film 113, the shared electrode terminal unit and the wiring electrode terminal unit are exposed.

For example, polyimide precursor-containing solution is spin coated to form a film. The solution is baked for thermal polymerization, removed, and thereby burned and formed. After that, an etching mask is formed on the polyimide film, part of the polyimide film uncovered by the etching mask is etched and removed, and the polyimide film is thereby patterned. The etching mask is formed as follows. The polyimide film is coated with a photosensitive resist, then prebaked, exposed with light where it is covered with a mask on which a desired pattern is formed, developed, and postbaked.

Next, a cover tape is adhered to the protective film 113. The cover tape is, for example, a back-side protective tape for chemical mechanical polishing (CMP) for a silicon wafer. The pressure cell structure 200 with the cover tape is turned upside down, and the pressure cells 201, the flow control paths 202, 203, and the slits 204, 205 are formed through the pressure cell structure 200. The pressure cells 201, the flow control paths 202, 203, and the slits 204, 205 are formed by patterning.

An etching mask is formed on the pressure cell structure 200 being a silicon wafer, and part of the silicon wafer uncovered by the etching mask is removed by using a so-called vertical deep dry etching dedicated to silicon substrates. As a result, the pressure cells 201, the flow control paths 202, 203, and the slits 204, 205 are formed.

SF6 gas is used for this etching. The $SiO_2$ film of the vibration plate 109 and the polyimide film of the protective film 113 are not etched when SF6 gas is used. Because of this, the silicon wafer, which forms the pressure cells 201, is dry etched, but the vibration plate 109 and the other members are not dry etched.

Note that, instead of that etching, any one of various methods may be used such as wet etching in which chemical solution is used and dry etching in which plasma is used. The etching methods and the etching conditions may be changed depending on the materials of the insulation film, the electrode film, the piezoelectric film, and the like. After the etching process, in which each photosensitive resist film is used, is finished, the remaining photosensitive resist film is removed by using solution.

Next, the ink flow path structure 300 is bonded to the pressure cell structure 200. By bonding the ink flow path structure 300 to the pressure cell structure 200, the first and second connection ports 307, 308 are formed.

Next, a cover tape is adhered to the protective film 113, and the cover tape thereby covers the shared electrode terminal unit and the wiring electrode terminal unit. The cover tape is made of resin, and the cover tape can thereby be removed from the protective film 113 easily. Thanks to the cover tape, dusts and the ink-repellent film 116 (described later) less attach to the shared electrode terminal unit and the wiring electrode terminal unit.

Next, the ink-repellent film 116 is formed on the protective film 113. A liquid ink-repellent film material is spin coated on the protective film 113, and the ink-repellent film 116 is thereby formed. At this time, positive pressure air injected into the ink inlet port and the ink recovery port. As a result, positive pressure air is discharged from the nozzle 101 in communication with the ink supply flow path 304. When the liquid ink-repellent film material is coated on the protective film 113 in this situation, the ink-repellent film material less attaches to the inner wall of the nozzle 101. After the ink-repellent film 116 is formed, the cover tape is peeled from the protective film 113.

The inkjet head 21 is manufactured as the result of those steps. The inkjet head 21 is mounted in the inkjet printer 1. A controller is connected to the wiring electrode terminal unit via, for example, a flexible cable. Further, the ink inlet port and the ink recovery port of the ink flow path structure 300 are connected to the ink tanks 501, 502.

According to the inkjet printer 1 of the first embodiment, the pressure cell structure 200 includes the flow control paths 202, 203 and the slits 204, 205, which control flow of ink in each pressure cell 201. The flow control path 202 and the slit 204 are at one side of the pressure cell 201, and the flow control path 203 and the slit 205 are at the other side of the pressure cell 201, the pressure cell 201 being therebetween. According to this structure, when the inkjet printer 1 operates, ink flows into the ink supply flow path 304, passes through the first connection port 307, and flows into the flow control path 202 of the pressure cell structure 200. Further, the ink flows from the flow control path 202, passes through the slit 204, and flows into the pressure cell 201. Then, the ink in the pressure cell 201 passes through the slit 205, flows into the flow control path 203 side, passes through the second connection port 308, and flows into the ink recovery flow path 305. As a result, the ink in the pressure cell 201 is constantly refilled. As a result, even if air bubbles are generated in the pressure cell 201, the air bubbles are discharged from the second connection port 308 together with ink. So it is possible to prevent poor ink ejection from occurring due to air bubbles. Further, when the actuator 102 pressurizes ink in the pressure cell 201 and the ink is ejected from the nozzle 101, the slit 204 controls the pressurized ink flowing from the pressure cell 201 to the flow control path 202, and the slit 205 controls the pressurized ink flowing from the pressure cell 201 to the flow control path 203. As a result, the ink pushed out of the pressure cell 201 by the actuator 102 is ejected from the nozzle 101 effectively.

Further, because the ink is not kept in the pressure cell 201 but flows, the ink near the nozzle 101 is refilled constantly. As a result, the following situation is prevented from occurring; ink solvent in the nozzle 101 dries, the ink pigments aggregate, and the nozzle 101 is clogged with the pigment aggregates.

As described above, it is possible to prevent poor ink ejection from occurring due to air bubbles and aggregated pigments. So it is not necessary to refill the pressure cell 201 with ink, for example, to maintain the pressure cell 201. As a result, the operational efficiency of the inkjet printer 1 is increased, and maintenance costs may be decreased.

Further, because fresh ink is constantly supplied to the pressure cell 201, it is possible to keep the temperature of the ink in the pressure cell 201 constant. In other words, heat is generated when the nozzle plate 100 deforms, and the inkjet head 21 prevents increase of the temperature of the ink due to that heat from occurring. As a result, it is possible to prevent change of properties of the ink due to change of the temperature from occurring.

Second Embodiment

Figure 7:
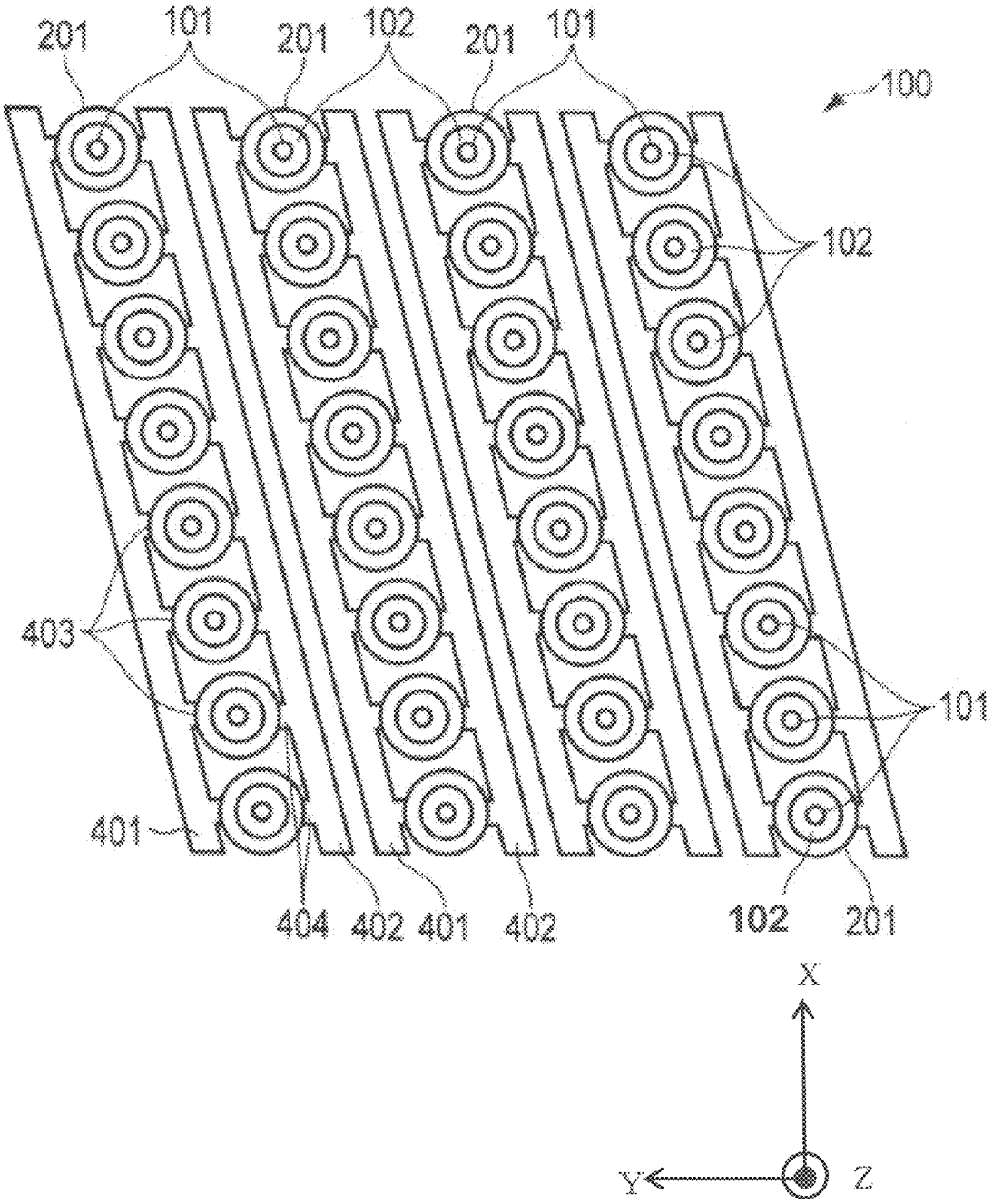
FIG. 7 is a plan view showing how pressure cells are formed and arranged on the substrate of the inkjet head of a second embodiment.

FIG. 7 shows a second embodiment. This embodiment shows a modification in which the structure of the inkjet head 21 of the first embodiment (see FIG. 1 to FIG. 6) is modified as follows.

In short, the inkjet head 21 of this embodiment includes the ink inlet-side flow control path 401. In the first embodiment, as shown in FIG. 3, each of the flow control paths 202 is a path segmented for each corresponding pressure cell 201. To the contrary, the ink inlet-side flow control path 401 is a common path including the flow control paths 202 of the first embodiment in communication with each other. The slit 403 is formed between the ink inlet-side flow control path 401 and each pressure cell 201. Further, the ink inlet-side flow control path 401 is in communication with each pressure cell 201 via each slit 403.

Further, the inkjet head 21 of this embodiment includes the ink outlet-side flow control path 402. In the first embodiment, as shown in FIG. 3, each of the flow control paths 203 is a path segmented for each corresponding pressure cell 201. To the contrary, the ink outlet-side flow control path 402 is a common path including the flow control paths 203 of the first embodiment in communication with each other. The slit 404 is formed between the ink outlet-side flow control path 402 and each pressure cell 201. Further, the ink outlet-side flow control path 402 is in communication with each pressure cell 201 via each slit 404.

As described above, the inkjet head 21 of this embodiment includes the ink inlet-side flow control path 401, which includes the ink inlet-side flow control paths 202 for the pressure cells 201 in communication with each other, and the ink outlet-side flow control path 402, which includes the ink outlet-side flow control paths 203 for the pressure cells 201 in communication with each other. With this structure, the structure of the pressure cell structure 200 is made simple, and the pressure cell structure 200 is manufactured easily.

According to the inkjet head and the inkjet recording apparatus of the embodiments, it is possible to prevent air bubbles from remaining in the pressure cell, and to prevent poor ink ejection from occurring.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of this embodiments described herein may be made without departing from the spirit of the inventions. The accompanying claims and their equivalents are intended to cover such forms or modifications as would fall within the scope and spirit of the inventions.

What is claimed is:

1. An inkjet head, comprising:

a pressure cell structure having a first end surface and a second end surface;

a nozzle plate on a side of the first end surface of the pressure cell structure; and an ink flow path structure positioned on the second end surface of the pressure cell structure, wherein the pressure cell structure includes:

pressure cells that retain ink, each of the pressure cells being formed in a thickness direction of the pressure cell structure from the first end surface of the pressure cell structure to the second end surface of the pressure cell structure, flow control paths, each of which is in fluid communication with one of the pressure cells, each of the pressure cells being interposed between two of the flow control paths, each of the flow control paths being formed in the thickness direction of the pressure cell structure, and slits, each of which is in fluid communication with one of the pressure cells through one of the flow control paths, each of the slits having a width smaller than a width of each of the pressure cells, the nozzle plate includes:

actuators formed on the first end surface of the pressure cell structure, each of the actuators covering one of the pressure cells, the actuators deforming in the thickness direction of the pressure cell structure depending on a drive voltage, and nozzles, each of the nozzles corresponding to one of the actuators, each of the nozzles being in fluid communication with one of the pressure cells, each of the nozzles ejecting the ink retained in one of the pressure cells in response to the corresponding actuator deforming, and the ink flow path structure includes:

ink flow paths in fluid communication with the pressure cells via the flow control paths and the slits.

2. The inkjet head according to claim 1, wherein the ink flow paths of the ink flow path structure include:

an ink supply flow path in fluid communication with one of the two interposing flow control paths at one side of the pressure cell, and an ink recovery flow path in fluid communication with another of the two interposing flow control paths at the other side of the pressure cell.

3. The inkjet head according to claim 2, wherein the ink flow path structure includes:

a first connection port in fluid communication with the flow control path at one side of the pressure cell, and a second connection port in fluid communication with the flow control path at the other side of the pressure cell, wherein the ink flows into the flow control path at the one side of the pressure cell from the ink supply flow path via the first connection port, and the ink flows into the ink recovery flow path from the flow control path at the other side of the pressure cell via the second connection port.

4. The inkjet head according to claim 1, wherein the flow control paths include path segments for the pressure cells.

5. The inkjet head according to claim 1, wherein each slit has a width the same as a width of a corresponding nozzle.

6. The inkjet head according to claim 1, wherein:

the flow control path at the one side of the corresponding pressure cell is a common path in fluid communication with each other side of the pressure cell, and the flow control path at the other side of the corresponding pressure cell is a common path in fluid communication with the corresponding flow control path of adjacent pressure cells.

7. An inkjet recording apparatus, comprising:

a conveyer apparatus that conveys recording paper; and an inkjet head that ejects ink onto the recording paper conveyed by the conveyer apparatus to form an image, wherein:

the inkjet head includes:

a pressure cell structure having a first end surface and a second end surface, a nozzle plate on a side of the first end of the pressure cell structure, and an ink flow path structure positioned on the second end surface of the pressure cells structure, the pressure cell structure including:

pressure cells that retain ink, each of the pressure cells being formed in a thickness direction of the pressure cell structure from the first end surface of the pressure cell structure to the second end surface of the pressure cells structure, flow control paths, each of which is in fluid communication with one of the pressure cells, each of the pressure cells being interposed between two of the flow control paths, the flow control paths being formed in the thickness direction of the pressure cell structure, and slits, each of which is in fluid communication with one of the pressure cells and through one of the flow control paths, each of the slits having a width smaller than a width of the pressure cells, the nozzle plate includes:

actuators formed on the first end surface of the pressure cell structure, the actuators covering one of the pressure cells, the actuators deforming in the thickness direction of the pressure cell structure depending on a drive voltage, and nozzles, each of the nozzles corresponding to one of the actuators, each of the nozzles being in fluid communication with one of the pressure cells, the nozzles ejecting the ink retained in one of the pressure cells in response to the corresponding actuator deforming, and the ink flow path structure includes:

ink flow paths in fluid communication with the pressure cells via the flow control paths and slits.

8. The inkjet recording apparatus according to claim 7, wherein each slit has a width the same as a width of a corresponding nozzle.

9. The inkjet recording apparatus according to claim 7, wherein, for a plurality of the pressure cells:

one of the two flow control paths at one side of each of the plurality of pressure cells is a common path in fluid communication with each other, and another of the two flow control paths at the other side of the plurality of pressure cells is a common path in fluid communication with each other.

10. An inkjet head, comprising:

a nozzle plate having a plurality of nozzles configured to eject ink in a first direction;

a plurality of actuators arranged on the nozzle plate, each of which corresponding with one of the nozzles, the plurality of actuators configured to deform based on a drive voltage;

a pressure chamber structure having a first surface on which the nozzle plate is formed and a second surface parallel to the first surface;

a pressure chamber formed between the first surface and the second surface of the pressure chamber structure and in fluid communication with one of the nozzles;

a first slit formed in a sidewall of the pressure chamber, extending from the second surface of the pressure chamber structure and in fluid communication with the pressure chamber, a width of the first slit in a second direction perpendicular to the first direction being smaller than a width of the pressure chamber;

a second slit formed in the sidewall of the pressure chamber structure at a different position from the first slit, extending from the second surface of the pressure chamber and in fluid communication with the pressure chamber, a width of the second slit in a third direction perpendicular to the first direction being smaller than the width of the pressure chamber;

a first flow control path in fluid communication with the first slit;

a second flow control path in fluid communication with the second slit; and an ink flow path structure disposed on the second surface of the pressure chamber structure, the ink flow path structure including a first ink flow path in fluid communication with the first flow control path and a second ink flow path in fluid communication with the second flow control path.

11. The inkjet head according to claim 10, wherein:

a width of the first flow control path in the second direction is greater than the width of the first slit, and a width of the second flow control path in the third direction is greater than the width of the second slit.

12. The inkjet head according to claim 11, wherein:

the pressure chamber is a circular hole, and the width of the pressure chamber is a diameter.

13. The inkjet head according to claim 12, wherein:

the second slit is positioned at an opposite side of the pressure chamber to the first slit, and the second direction and the third direction are same direction.

14. The inkjet head according to claim 13, wherein:

the first slit and the second slit each extend from the second surface of the pressure chamber structure to the first surface.

15. The inkjet head according to claim 14, wherein:

the first flow control path and the second flow control path each include a portion that extends from the second surface of the pressure chamber structure to the first surface of the pressure chamber structure.

* * * * *